US006085062A

United States Patent [19]

Mizuishi et al.

[11] Patent Number: 6,085,062

[45] Date of Patent: Jul. 4, 2000

[54] ELECTROPHOTOGRAPHIC IMAGE FORMING APPARATUS

[75] Inventors: Haruji Mizuishi; Ken Amemiya; Hiroshi Mizusawa; Hiroyuki Ohkaji; Mayumi Ohori; Masaru Tanaka; Hideki Zenba; Kenzou Tatsumi, all of Tokyo, Japan

[73] Assignee: Ricoh Company, Ltd., Tokyo, Japan

[21] Appl. No.: 09/289,394

[22] Filed: Apr. 12, 1999

[30] Foreign Application Priority Data

Apr. 10, 1998 [JP] Japan ..... 10-116118

[51] Int. Cl.[7] ..... G03G 21/10

[52] U.S. Cl. ..... 399/358

[58] Field of Search ..... 399/358, 359, 399/254

[56] References Cited

U.S. PATENT DOCUMENTS

| | | | |
|---|---|---|---|
| 4,941,022 | 7/1990 | Ohmura et al. | 399/358 |
| 5,526,100 | 6/1996 | Misago et al. | 399/358 |
| 5,708,952 | 1/1998 | Taniguchi et al. | 399/358 |

*Primary Examiner*—Arthur T. Grimley
*Assistant Examiner*—Remmon R. Forde'
*Attorney, Agent, or Firm*—Oblon, Spivak, McClelland, Maier & Neustadt, P.C.

[57] ABSTRACT

An electrophotographic image forming apparatus is disclosed which is provided within a cleaning device with a rotative conveying member for conveying a residual toner after removal thereof from a photoreceptor up to an inlet of a toner dropping path while rotating. Within the toner dropping path is disposed a toner bridge preventing member for preventing the formation of a toner bridge in the same path. The toner bridge preventing member is driven by the rotative conveying member so as to reciprocate substantially in parallel with the toner dropping direction.

6 Claims, 7 Drawing Sheets

ELECTROPHOTOGRAPHIC IMAGE FORMING APPARATUS

BACKGROUND OF THE INVENTION

1. Field of the Invention

The present invention relates to an electrophotographic image forming apparatus such as a copying machine, a printer, a facsimile device, or a composite machine thereof, wherein an image formed on an image support member by an electrophotographic method using laser beam for example is transferred and recorded onto a recording medium such as paper.

2. Description of the Related Art

In the conventional image forming apparatus of this type, a toner remaining on an image support member after the transfer of an image onto a recording medium is removed using a cleaning member such as blade or brush. Then, as shown in FIG. 7, the removed toner is conveyed through a conveying path 1*a* of a cleaning case 1 by means of a conveying screw 2 as a rotative conveying member and is gathered on one end side of a cleaning device 3. The toner thus gathered on one end side drops from a downward opening 1*b* of the cleaning case 1 into a horizontal conveying path 5 by virtue of its own weight through a vertical dropping path 4. The toner thus dropped into the conveying path 5 is then further conveyed through the same path into, for example, a waste toner recovery tank by means of a conveying screw 6 and is discarded, or is returned into a developing device for recycle use.

However, as the ambient conditions of the image forming apparatus become high in temperature and humidity, the toner which is passing through the dropping path 4 will adhere halfway to an inner surface 4*a* of the dropping path and will grow gradually as deposit layers a, b and c, as shown in FIG. 7, resulting in that the interior of the dropping path 4 becomes narrower, which condition may eventually lead to the formation of a toner bridge. This toner bridge prevents the toner from dropping into the conveying path 5, thus obstructing the recovery of the toner.

In a certain conventional image forming apparatus, in order to prevent the formation of such a toner bridge, an agitator 7 adapted to rotate with a driving force provided from the exterior is disposed within the dropping path 4, as shown in FIG. 8, and the toner deposited on the inner surface 4*a* of the dropping path 4 is scraped off by rotating the agitator 7.

In such an image forming apparatus, however, it is necessary to separately provide such components as gears and belt for the transfer of a rotative driving force to the agitator 7, thus giving rise to the problem that the number of components used so much increases and hence the cost becomes higher.

In view of this point there has been proposed such an image forming apparatus as shown in FIG. 9 in which a pipe knock lever 100 for imparting vibrations to the inner surface 4*a* of the dropping path 4 is disposed within the dropping path. The pipe knock lever 100 is constituted by an elastic plate such as a plate spring and its upper end portion is fixed to the inner surface 4*a* of the dropping path 4 with a screw 101, while the opposite end portion thereof, indicated at 103, is a free end. The free end 103 projects into the conveying path 5 up to a position in which it gets into the spiral groove of the conveying screw 6. Consequently, the free end 103 comes into engagement with the blade of the conveying screw 6 and is pushed in the direction of arrow A with rotation of the conveying screw 6. As a result, the pipe knock lever 100 deflects like a broken line in the figure with its upper end portion as fulcrum. When the free end 103 reaches point B in the figure, the end portion 103 and the blade of the conveying screw 6 are disengaged from each other, whereupon the pipe knock lever 100 turns suddenly in the counterclockwise direction with its upper end portion as fulcrum by virtue of its elasticity and a bent portion 102 thereof knocks the inner surface 4*a* of the dropping path 4. This knocking motion causes vibration of the inner surface 4*a*, so that the toner deposited on the inner surface drops into the conveying path 5.

In this conventional image forming apparatus it is not necessary to separately provide such components as gears and belt for rotating the agitator 7, but since the pipe knock lever 100 knocks the inner surface 4*a* of the dropping path 4 intermittently and generates vibration of the inner surface, there occurs not only a vibration noise but also dislocation of the entire apparatus including the dropping path. Such a condition may result in the screw 6 coming into contact with the inner surface of the conveying path 5 and becoming immovable.

SUMMARY OF THE INVENTION

It is an object of the present invention to provide an electrophotographic image forming apparatus capable of preventing the formation of a toner bridge in a toner dropping path without separate provision of such driving force transfer components as gears and belt and without imparting excessive vibrations to the toner dropping path and a device which supports the same path and hence without generating an excessive noise.

In order to achieve the above-mentioned object, according to the present invention, in the first aspect thereof, there is provided an electrophotographic image forming apparatus wherein a toner bridge preventing member for preventing the formation of a toner bridge is disposed within a toner dropping path, the toner bridge preventing member being driven by a rotative conveying member which performs a reciprocating motion substantially parallel to the toner dropping direction.

According to this first aspect, since the toner bridging preventing member can be allowed to perform a reciprocating motion substantially parallel to the toner dropping direction by utilizing a rotating motion of the rotative conveying member, there is obtained an effect that the formation of a toner bridge in the toner dropping path can be prevented without the provision of any driving force transfer component and without imparting excessive vibrations to the toner dropping path and a device which supports the same path and hence without generating an excessive noise.

In the second aspect of the present invention there is provided, in combination with the first aspect, an electrophotographic image forming apparatus wherein the rotative conveying member has an eccentric shaft portion, and the toner bridge preventing member is engaged with the said eccentric shaft portion.

According to this second aspect, such a simple construction can afford the same effect as in the first aspect.

In the third aspect of the present invention there is provided, in combination with the second aspect, an electrophotographic image forming apparatus wherein the toner bridge preventing member has a hook portion and is engaged with the eccentric shaft portion through the said hook portion.

According to this third aspect there is obtained an effect that the toner bridge preventing member can be brought into engagement with the rotative conveying member extremely easily.

In the fourth aspect of the present invention there is provided, in combination with the third aspect, an electrophotographic image forming apparatus wherein a value obtained by multiplying the radius of curvature of the hook portion by two is larger by 0.5 mm or more than the diameter of the eccentric shaft portion.

According to this fourth aspect there is obtained an effect that the toner bridge preventing member can be reciprocated surely and smoothly, thus making it possible to scrape off the toner effectively.

In the fifth aspect of the present invention there is provided, in combination with the first aspect, an electrophotographic image forming apparatus wherein the toner dropping path has an inclined dropping surface on which the toner slips down, and the toner bridge preventing member is formed as a rectangular plate extending along the dropping surface, with a plurality of projections being formed on the plate which projections come into abutment against the dropping surface to scrape off the toner.

According to this fifth aspect there is obtained an effect that the toner deposited on the dropping surface can be scraped off effectively by the plurality of projections.

In the sixth aspect of the present invention there is provided, in combination with the fifth aspect, an electrophotographic image forming apparatus wherein the plate of the toner bridge preventing member is formed with relief holes for escape of the toner therethrough.

According to this sixth aspect there is obtained an effect that it is possible to prevent the toner from being nipped between the dropping surface and the toner bridge preventing member and becoming agglomerated with formation of a toner bridge.

BRIEF DESCRIPTION OF THE DRAWINGS

The above and other objects, feature and advantages of the present invention will become more apparent from the following description taken in connection with the accompanying drawings, in which.

DESCRIPTION OF THE PREFERRED EMBODIMENT

Figure 1:
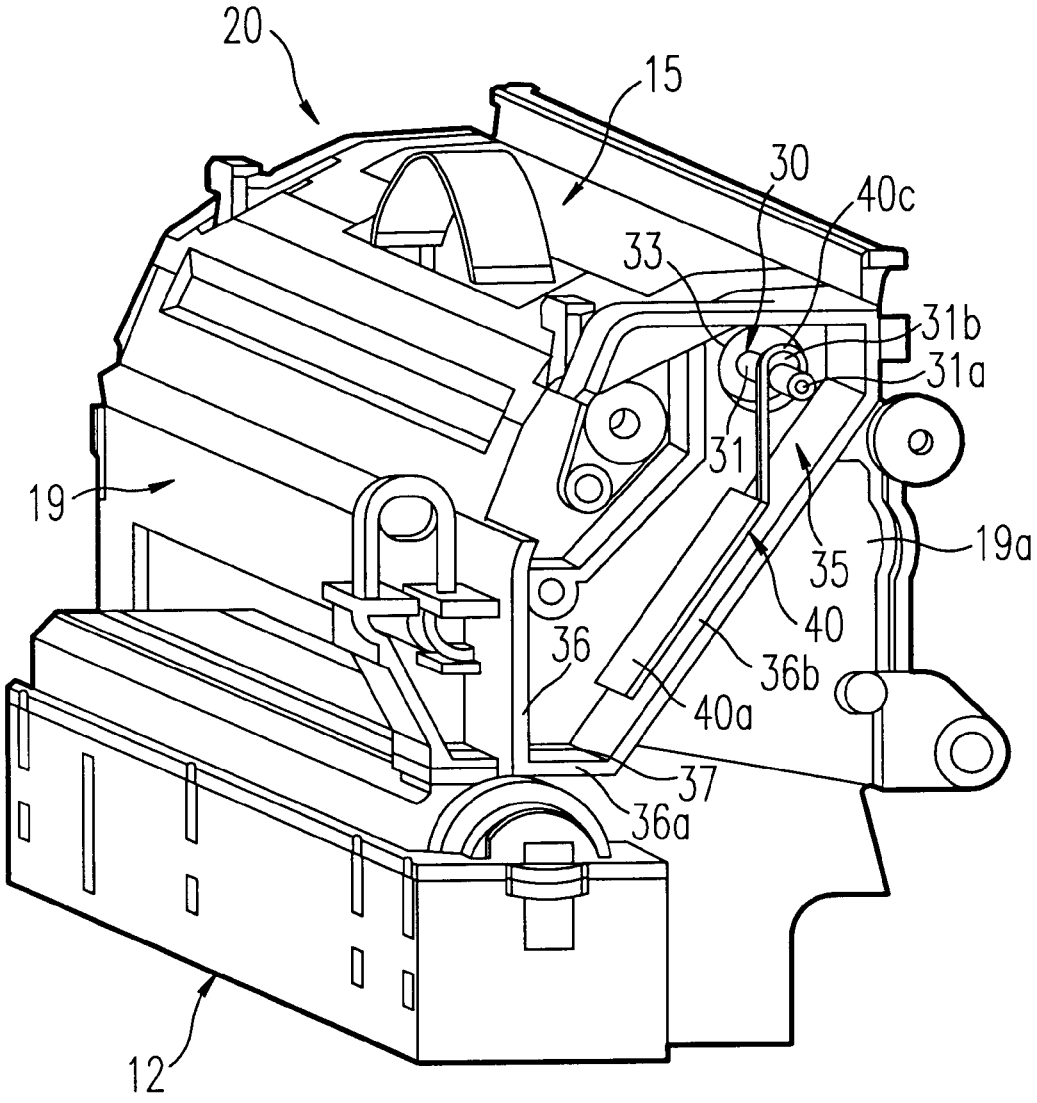
FIG. 1 is a perspective view showing a photoreceptor unit used in a laser copier according to an embodiment of the present invention.

The electrophotographic image forming apparatus of the present invention will be described hereinunder by way of an embodiment thereof illustrated in the drawings.

Figure 4:
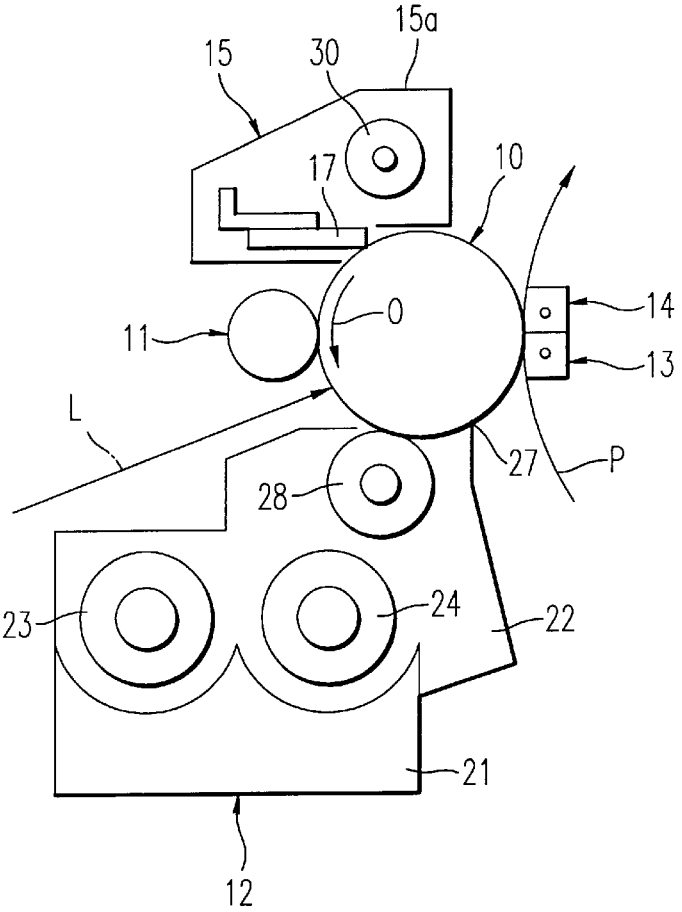
FIG. 4 is a schematic construction diagram showing a principal portion of the laser copier having the photoreceptor unit of FIG. 1.

FIG. 4 is a schematic construction diagram showing a principal portion of a laser copier as an image forming apparatus according to an embodiment of the present invention.

In the same figure, the reference numeral 10 denotes a drum-like photoreceptor as an image support member. A roller-like charging device 11 is disposed on the left-hand side of the photoreceptor 10, and around the photoreceptor 10 are further disposed a developing device 12, a transfer device 13, a paper separating device 14 and a cleaning device 15 successively from the charging device 11 and in a rotational direction indicated with arrow O in the photoreceptor 10.

For copying an image in this copier, first an original is put on an original-carrying table (not shown) of the copying machine and a copy switch (not shown) for the start of copying is turned ON. Upon turning ON of the copy switch, an image on the original is read by an optical reader (not shown) and at the same time paper is fed upward of the photoreceptor 10 as indicated with arrow P.

As the photoreceptor 10 rotates, the surface thereof is electrically charged uniformly by the charging device 11 and a laser beam L corresponding to the image read from the original is radiated to the thus-charged surface of the photoreceptor 10 from an optical writing device (not shown). As a result, an electrostatic latent image of the read image is formed on the photoreceptor 10. When the photoreceptor 10 rotates and the surface thereof with the electrostatic latent image formed thereon passes the position of the developing device 12, toner is adhered to the surface of the photoreceptor 10 by means of the developing device 12, whereby the electrostatic latent image is developed into a visible image. Then, by means of the transfer device 13 the visible image on the photoreceptor 10 is transferred onto paper P which has been fed to a right-hand position with respect to the photoreceptor 10 in the figure.

The paper P with the visible image transferred thereon is then separated from the photoreceptor 10 by means of the paper separating device 14 and is conveyed to a fixing device (not shown). The transferred image on the paper P is fixed by the fixing device and the paper P is then discharged to a paper discharge section (not shown).

On the other hand, after the transfer of the image onto paper P, the toner remaining on the surface of the photoreceptor 10 is scraped off with a cleaning blade 17 of the cleaning device 15 and thus the surface of the photoreceptor 10 is cleaned.

In this copying machine, as shown in FIG. 1, the photoreceptor 10, the charging device 11, the developing device 12 and the cleaning device 15 are integrally supported within a support case 19 to constitute a single photoreceptor unit 20. Though not shown, the photoreceptor unit 20 is attached removably to side plates which are disposed opposedly to each other in front and rear positions within the body of the copying machine, and thus the photoreceptor unit 20 can be replaced.

Figure 3:
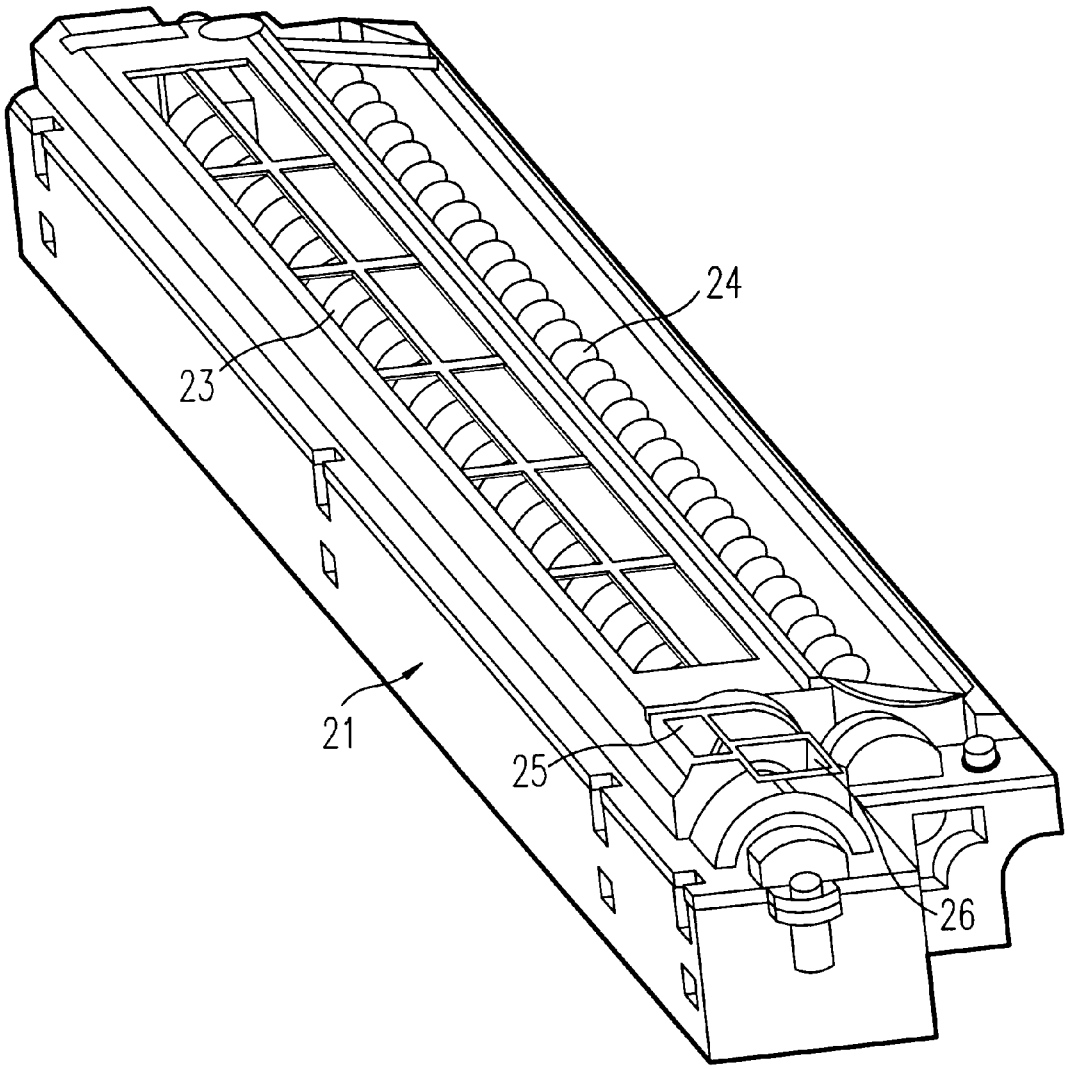
FIG. 3 is a perspective view showing a developer storage portion of the photoreceptor unit shown in FIG. 1.

In the photoreceptor unit 20, as shown in FIG. 4, the developing device 12 is provided with a developer storage portion 21 on the lower side and a developing chamber 22 on the upper side. Within the developer storage portion 21 is stored a two-component developer and are disposed a first agitation member 23 and a second agitation member 24 which are agitating rollers for agitating and conveying the developer, as shown also in FIG. 3. Further, on a front side (on this side in FIG. 3) of the developer storage portion 21 there are formed a fresh toner supply port 25 and a recycle toner supply port 26 which are each opened upward. On the other hand, in the developing chamber 22 is disposed a developing roller 28 at a position opposed to the photoreceptor 10 through a developing window 27.

Figure 2:
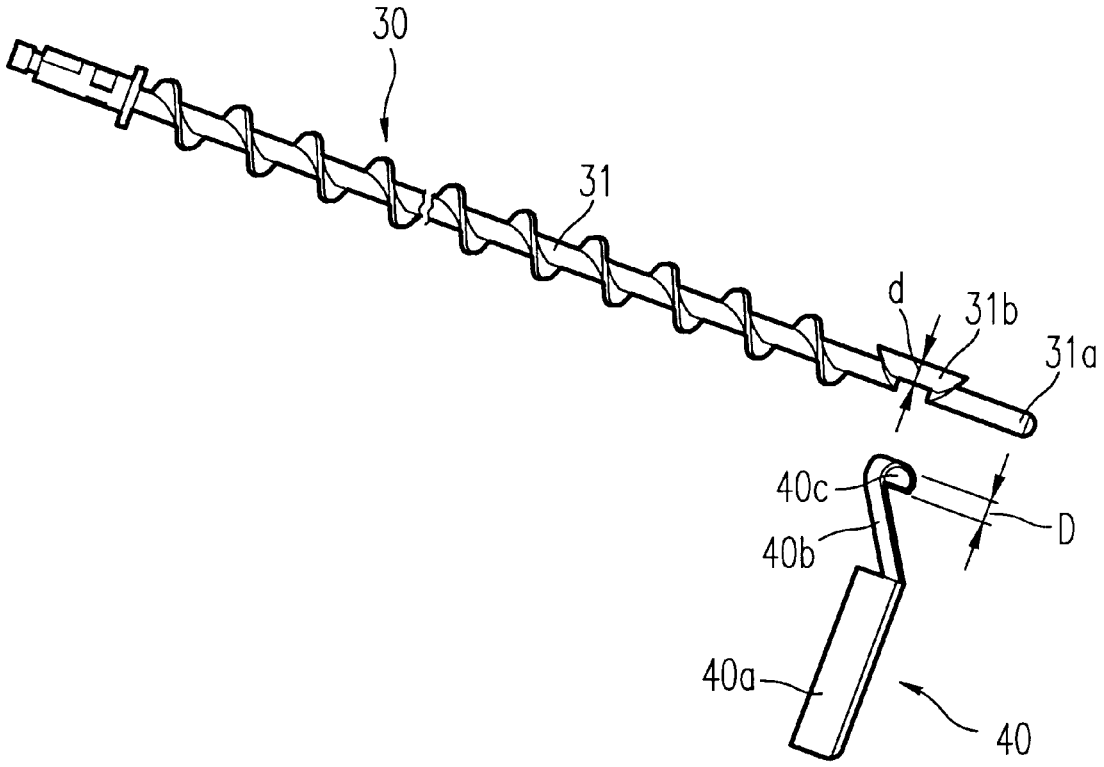
FIG. 2 is a perspective view showing a conveying screw and a toner bridge preventing member both used in the photoreceptor unit of FIG. 1.

Within a case 15*a* of the cleaning device 15 is disposed a screw 30 as a rotative conveying member for conveying the residual toner which has been scraped off by the cleaning blade 17. The conveying screw 30 is disposed axially of the photoreceptor 10 in such a manner that one end portion 31*a* of a rotating center shaft 31 thereof gets into a toner dropping path 35 from a dropping path inlet 33 formed on the upper side of a front plate portion 19*a* of the support case 19, as shown in FIG. 1. The conveying screw 30 is formed by monolithic molding using a resin material and, as shown in FIG. 2, an eccentric shaft portion 31*b* for engagement with a toner bridge preventing member 40 is formed on one end portion 31*a* side of the rotating center shaft 31. The toner bridge preventing member 40 is bent in a dogleg shape using a resin material such as ABS resin for example. The lower half of the dogleg shape is formed as a rectangular, toner receiving plate portion 40*a*, while the upper half is formed as an elongated engaging portion 40*b*, and a hook portion 40*c*, which is curved in a cylindrical shape, is formed at an upper end of the engaging portion 40*b*. The hook portion 40*c* is curved so that a length D obtained by multiplying the radius of curvature of the hook portion by two is larger than the diameter, d, of the eccentric shaft portion 31*b*. It is preferable that the length D be larger at least 0.5 mm than the shaft diameter, d. The material of the toner bridge preventing member 40 is not limited to a resin, but the same member may be formed, for example, using a metallic plate of an appropriate metallic material having elasticity.

A peripheral wall 36 is formed outside the front plate portion 19*a* so that the toner dropping path 35 is formed inside the peripheral wall 36 in a hermetically sealed manner. In FIG. 1, the front side of the peripheral wall 36 is removed so that the interior thereof can be seen. The toner dropping path 35 has a dropping path outlet 37 which is formed in a bottom 36*a* of the peripheral wall 36 and which leads to the recycle toner supply port 26 of the developing device 12. Further, a portion of the peripheral wall 36 located between the dropping path outlet 37 and the dropping path inlet 33 is inclined and a residual toner dropping surface 36*b* is formed on an inner side of the inclined portion. On the dropping surface 36*b* is placed the toner receiving plate portion 40*a* of the toner bridge preventing member 40 whose hook portion 40*c* is engaged with the eccentric shaft portion 31*b* of the rotating center shaft 31.

The operation of this copying machine will be described below.

In the developing device 12, the agitating rollers 23 and 24 are rotated by means of a drive motor (not shown) during copying operation, whereby the developer is agitated. As a result of the developer being agitated, the toner and carrier are charged frictionally and are fed to the developing roller 28. The developing roller 28 is driven and rotated by the above drive motor and is supplied with a predetermined bias voltage from a power supply (not shown). With this bias voltage, the toner in the developer which has been fed to the developing roller is adhered to the surface of the photoreceptor 10 electrostatically, whereby the electrostatic latent image on the photoreceptor surface is developed into a visible image.

On the other hand, in the cleaning device 15, the conveying screw 30 is rotated, and with this rotation of the conveying screw 30, the residual toner which has been removed from the photoreceptor 10 is gathered on the front side in FIG. 4 within the cleaning case 15*a* and drops into the dropping path 35 from the dropping path inlet 33 shown in FIG. 1. A large proportion of the residual toner which has thus entered the dropping path 35 drops onto the toner receiving plate portion 40*a* of the toner bridge preventing member 40. The rotating motion of the conveying screw 30 is transmitted to the toner bridge preventing member 40, which in turn reciprocates at a stroke twice as large as the amount of eccentricity of the eccentric shaft portion 31*b*, so that the residual toner now on the toner receiving plate portion 40*a* is shaken off and drops through the dropping path 35 without being deposited on the toner receiving plate portion and is recovered into the developer storage portion 21 through the dropping path outlet 37 and the recycle toner supply port 26.

Figure 5:
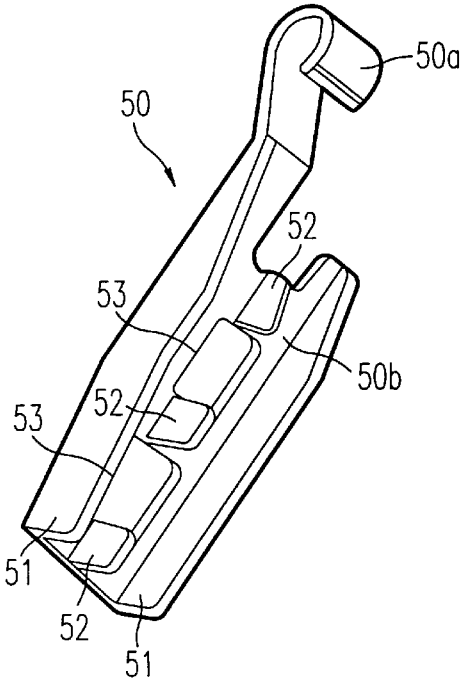
FIG. 5 is a perspective view showing a modification of the toner bridge preventing member used in the photoreceptor unit of FIG. 1.

As the toner bridge preventing member there may be used any of various shapes. FIG. 5 shows one modification thereof. A toner bridge preventing member 50 according to this modification is made of resin and has a hook portion 50*a* which is the same as that of the foregoing toner bridge preventing member 40. Further, the toner bridge preventing member 50 has a toner receiving plate portion 50*b*, both sides of which are bent opposedly to each other to form plate-like projections 51. On the toner receiving plate portion 50*b* and between the plate-like projections 51 there are formed a plurality of small projections 52. Further, rectangular relief holes 53 are formed in the toner receiving plate portion 50*b* and between the small projections 52.

Figure 6:
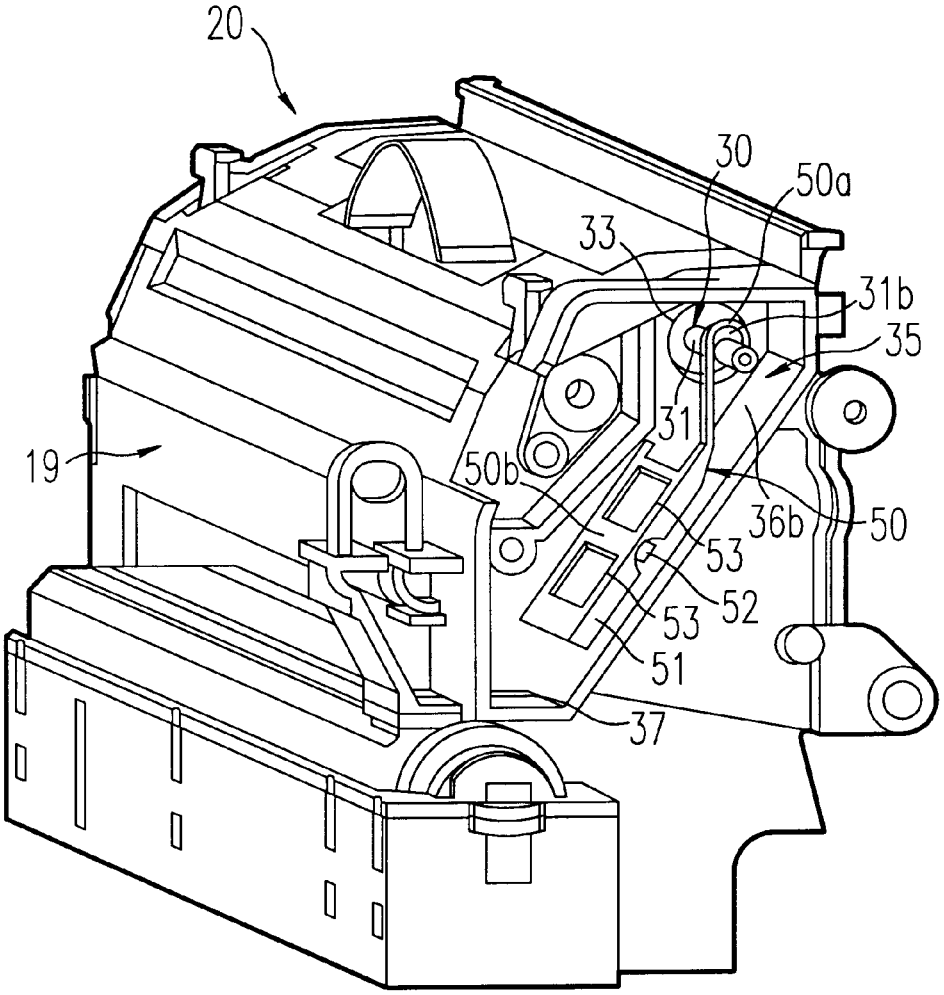
FIG. 6 is a perspective view of the photoreceptor unit of FIG. 1 with the toner bridge preventing member of FIG. 5 attached thereto.
Figure 7:
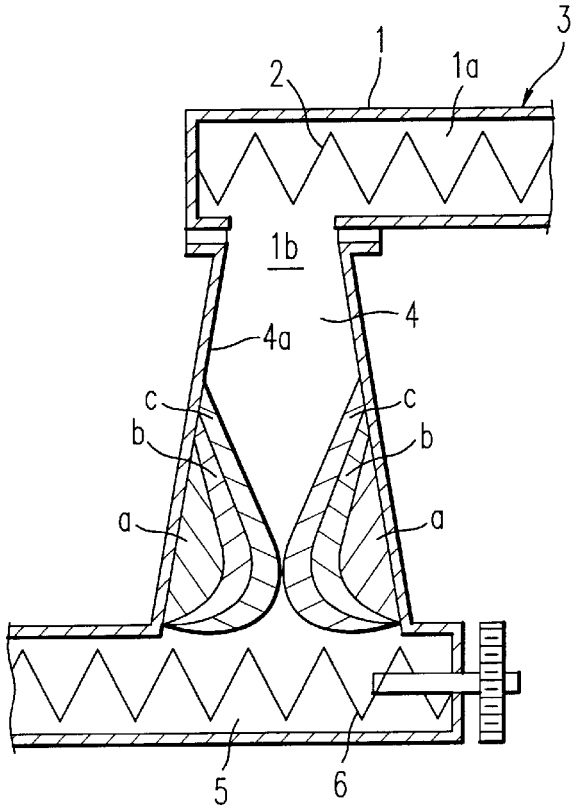
FIG. 7 (PRIOR ART)
FIG. 7 is a sectional view showing in what state a toner bridge is formed in a toner dropping path of a conventional image forming apparatus.
Figure 8:
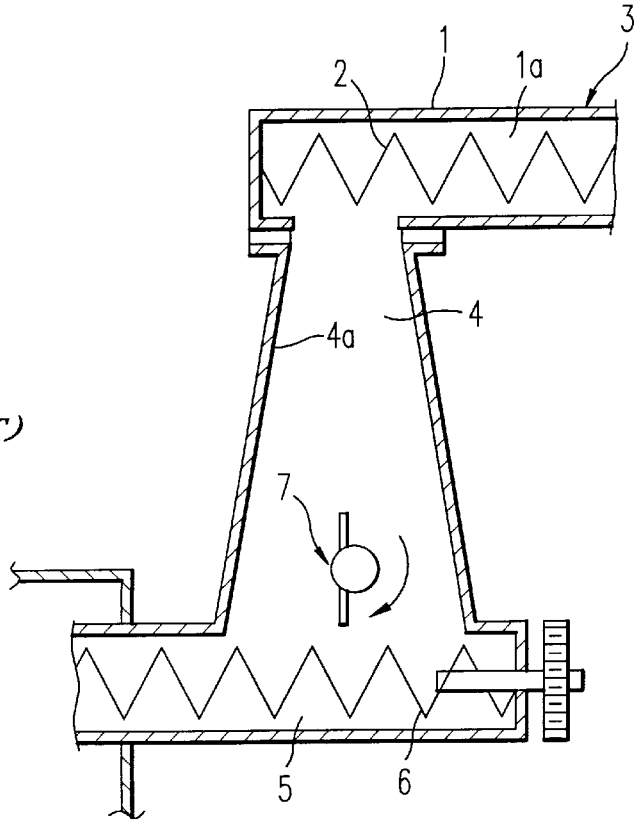
FIG. 8 (PRIOR ART)
FIG. 8 is a partial sectional view showing an example of a toner dropping path used in a conventional image forming apparatus.
Figure 9:
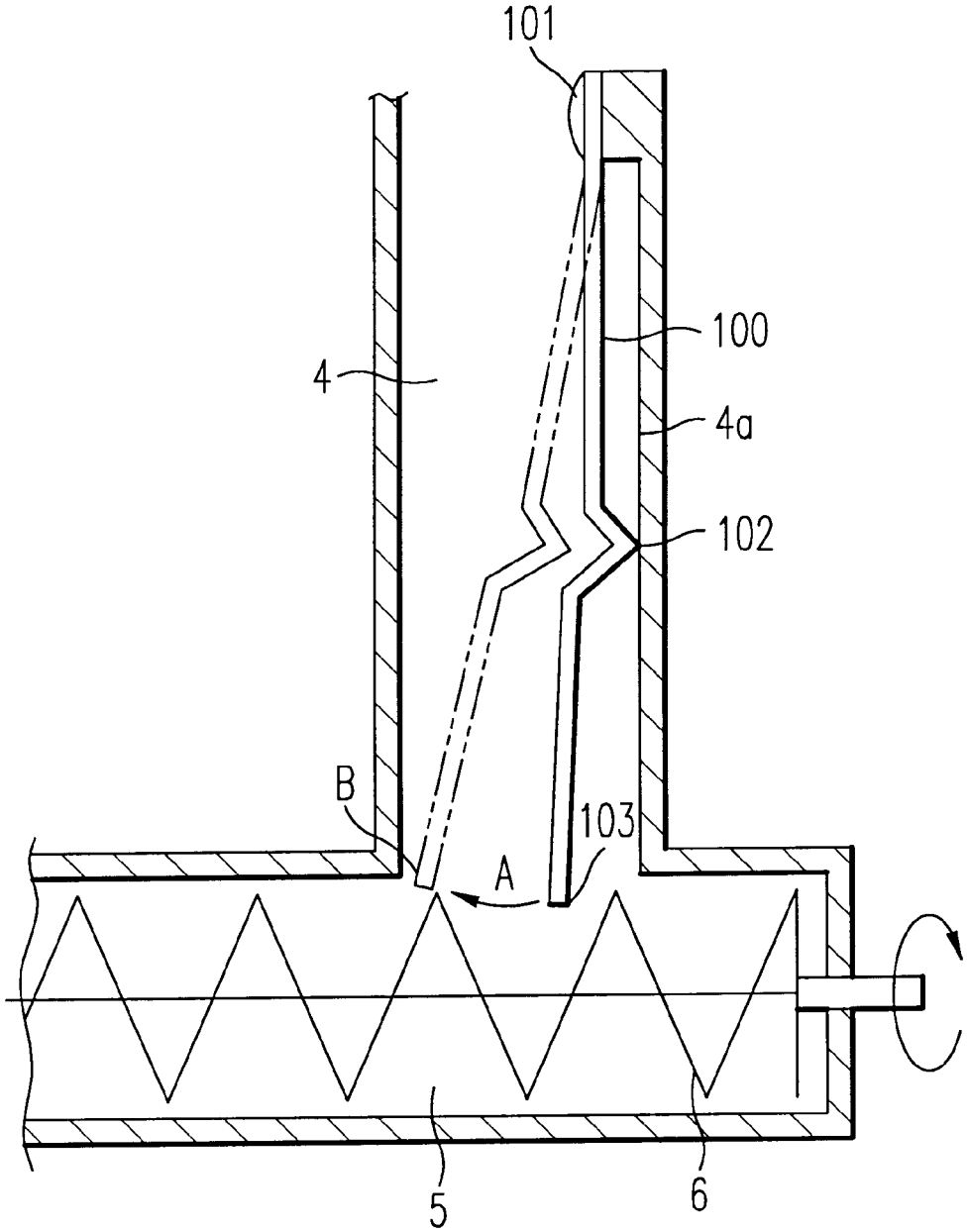
FIG. 9 (PRIOR ART)
FIG. 9 is a partial sectional view showing another example of a toner dropping path used in a conventional image forming apparatus.

As shown in FIG. 6, the toner bridge preventing member 50 is disposed within the toner dropping path 35, with its hook portion 50*a* engaged with the eccentric shaft portion 31*b* of the conveying screw 30 and its projections 51 and 52 put on the toner dropping surface 36*b*.

When the residual toner is recovered in the presence of the toner bridge preventing member 50, a large proportion of the toner which has entered the dropping path 35 from the dropping path inlet 33 drops onto the dropping surface 36*b* and slips down on the dropping surface by virtue of its own weight, then is discharged from the dropping path outlet 37. At this time, the rotating motion of the conveying screw 30 is transmitted to the toner bridge preventing member 50, which in turn reciprocates, so that the projections 51 and 52 slide on the dropping surface 36*b*, thereby scrape off the toner deposited on the dropping surface 36*b* and cause the toner thus scraped off to be discharged through the dropping path outlet 37. In this case, a portion of the toner which is dropping between the projections 51 and 52 of the toner bridge preventing member 50 escapes to above the toner bridge preventing member 50 through the relief holes 53, so that the toner is prevented from being deposited between the dropping surface 36*b* and the toner bridge preventing member 50 and is therefore prevented from being bridged.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. An electrophotographic image forming apparatus comprising:

an image support member for forming thereon a latent image of an image;

a charging device for charging said image support member electrically;

a light emitting device for forming said latent image on said image support member charged by said charging device;

a developing device for developing said latent image formed on said image support member by said light emitting device into a visible image;

a transfer device for transferring said visible image onto paper;

a cleaning device for removing toner which remains on said image support member;

a rotative conveying member for conveying said toner which has been removed from said image support member by said cleaning device; and a toner dropping path for allowing said toner conveyed by said rotative conveying member to drop into a developer storage device, with a toner bridge preventing member for preventing the formation of a toner bridge being disposed within said toner dropping path, said toner bridge preventing member being driven by said rotative conveying member so as to reciprocate substantially in parallel with the dropping direction of said toner.

2. The electrophotographic image forming apparatus according to claim 1, wherein said rotative conveying member is provided with an eccentric shaft portion, and said toner bridge preventing member is brought into engagement with said eccentric shaft portion.

3. The electrophotographic image forming apparatus according to claim 2, wherein said toner bridge preventing member is provided with a hook portion, said hook portion being brought into engagement with said eccentric shaft portion of said rotative conveying member.

4. The electrophotographic image forming apparatus according to claim 3, wherein a value obtained by multiplying the radius of curvature of said hook portion by two is larger by 0.5 mm or more than the diameter of said eccentric shaft portion.

5. The electrophotographic image forming apparatus according to claim 1, wherein said toner dropping path has an inclined toner dropping surface on which said toner slips down, and said toner bridge preventing member has a rectangular plate extending along said toner dropping surface, with a plurality of projections being formed on said plate, said projections coming into abutment against said toner dropping surface to scrape off the toner deposited on the toner dropping surface.

6. The electrophotographic image forming apparatus according to claim 5, wherein a relief hole for the escape of said toner therethrough is formed in said plate of said toner bridge preventing member.

* * * * *